United States Patent [19]

Mass

[11] 4,290,249

[45] Sep. 22, 1981

[54] ELASTOMERIC SPRING EXPANSION JOINT-SEAL STRIP

[75] Inventor: Ronald H. Mass, Naperville, Ill.

[73] Assignee: Schlegel Corporation, Rochester, N.Y.

[21] Appl. No.: 104,180

[22] Filed: Dec. 17, 1979

[51] Int. Cl.[3] ..... E01C 11/04; E04B 1/68

[52] U.S. Cl. ..... 52/396; 52/403; 404/65; 404/66; 404/68

[58] Field of Search ..... 404/68, 69, 47, 64, 404/65, 66; 52/396, 403, 573

[56] References Cited

U.S. PATENT DOCUMENTS

| | | | |
|---|---|---|---|
| 2,156,681 | 5/1939 | Dewhirst | 404/65 |
| 3,363,383 | 1/1968 | LaBarge | 52/573 X |
| 3,479,933 | 11/1969 | Hall | 404/69 X |
| 4,030,852 | 6/1977 | Hein | 404/66 |
| 4,067,660 | 1/1978 | Puccio | 52/396 X |

FOREIGN PATENT DOCUMENTS

| | | | |
|---|---|---|---|
| 790888 | 7/1968 | Canada | 404/65 |
| 2202083 | 7/1973 | Fed. Rep. of Germany | 52/573 |
| 1380395 | 1/1975 | United Kingdom | 404/65 |

*Primary Examiner*—Alfred C. Perham
*Attorney, Agent, or Firm*—Cumpston & Shaw

[57] ABSTRACT

The object of this invention is to provide an elastomeric spring expansion joint-seal strip for sealing the gap between expansion members in highways, bridges and the like.

The spring expansion joint-seal strip is an elongated seal strip of a substantially M-shaped cross section. The seal strip comprises an elongated web member for spanning a gap between a pair of structural slab members. The web member has flange portions extending along each longitudinal edge thereof. The flange portions support resilient grippers which are urged into sealing engagement with abutments on the slab members by spring means embedded within the elastomeric seal strip.

3 Claims, 3 Drawing Figures

ELASTOMERIC SPRING EXPANSION JOINT-SEAL STRIP

DESCRIPTION

Technical Field

This invention relates to expansion joint-seals, and particularly to an improved elastomeric spring expansion joint-seal strip.

Expansion joint-seals are used for sealing expansion joint gaps or spaces of the type encountered in highway or bridge construction against the intrusion of dirt, water or other foreign matter. It is desirable in such applications to provide a joint-seal strip of simple design that eliminates the need for intricate internal channels or grooves to achieve the desired expansive force against the joint walls. It is further desirable to provide a joint-seal strip that can be inserted or installed in the gap with a minimum of effort. Once installed, the seal resists disengagement and exhibits excellent set characteristics.

Background Art

U.S. Pat. No. 4,067,660 describes an expansion joint-seal strip having a gap spanning web member, and mounting beads on each of its longitudinal edges. Each mounting bead is of tubular construction, and mounted within generally C-shaped cavities on the edge members or abutments defining the gap between the slab members.

Some problems that may arise with the type of joint-seal strip disclosed in U.S. Pat. No. 4,067,660 are (1) increased cost of the joint due, for example, to the need for cavities in the abutments for receiving the mounting beads of the seal, (2) increased installation cost due to the need for forcibly inserting the mounting beads within the cavities, (3) the need for manufacturing the abutments and joint-seal strip to close tolerances so that the mounting beads properly mount within the cavities, and (4) the possibility of the seal material deteriorating with time and use resulting in the mounting beads becoming dislodged or disengaged from the cavities in the abutments.

U.S. Pat. No. 4,111,584 discloses an expansion joint-seal strip of a substantially inverted U-shaped cross section. The seal strip has a gap spanning member, and flange portions extending along each longitudinal edge thereof. The flange portions are sealingly secured to abutments on opposite sides of the gap by clamping plates cooperating with the abutments for adjustably squeezing the flange portions against the abutments.

One of the problems with a joint-seal assembly of the type disclosed in U.S. Pat. No. 4,111,584 is that it is expensive to manufacture. Also, to install a joint-seal assembly of this type is time consuming and costly. Still another problem is that if a flange portion should become disengaged, it is extremely difficult to reengage the disengaged portion.

Disclosure of the Invention

In accordance with the present invention, an improved elastomeric expansion joint-seal strip is provided for sealingly bridging the gap between a pair of spaced abutments on structural slab members. The joint-seal strip is of simple design and construction, comprising an elongated web member spanning the gap. The seal has a flange portion extending along each longitudinal edge of the web member. The seal further has spring means such as spring wire embedded within the joint-seal strip. The spring means expands the web member and urges the flange portions in the direction of the arrows shown in FIG. 2 into sealing engagement with the abutments when the seal strip is compressed and inserted between the abutments.

In a more specific aspect of the invention, gripping means such as resilient ribs are provided on each outer surface of the flange portions for sealingly gripping the abutment of a corresponding one of the slab members.

The aforementioned problems presented by the prior art joint-seals are solved by providing an improved joint-seal strip of simple design and construction. This is achieved, for example, by embedding spring means within the seal strip, and providing gripping means on the outer surfaces of the flange portions.

A primary advantage of the joint-seal strip of this invention is its economy of manufacture. Another advantage is its ease of installation. Other advantages are improved set characteristics and sealing ability.

The invention and its advantages will become more apparent from the detailed description of the invention presented below.

Brief Description of the Drawing

The details of the invention will be described in connection with the accompanying drawing, in which.

Best Mode for Carrying Out the Invention

Figure 1:
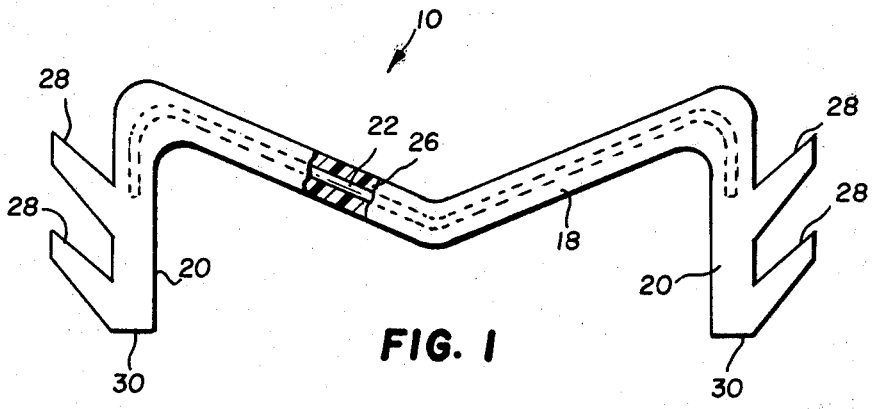
FIG. 1 is an enlarged side elevational view of the elastomeric spring expansion joint-seal strip of this invention.
Figure 2:
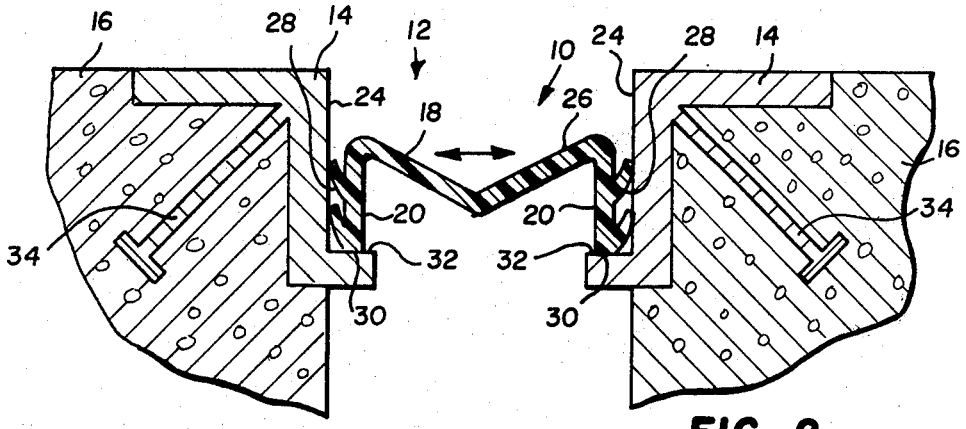
FIG. 2 is a side elevational view in section showing the position of the installed joint-seal strip when the slab members have contracted due to the cold.
Figure 3:
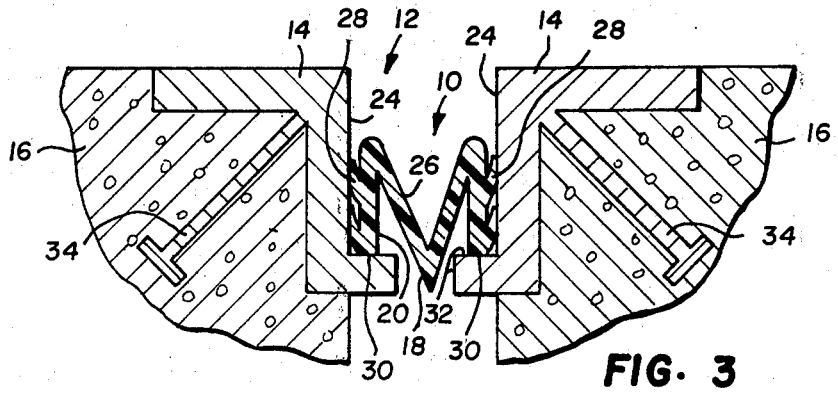
FIG. 3 is a view similar to FIG. 2 showing the position of the installed joint-seal strip when the slab members have expanded due to the heat.

Referring to FIG. 1, a joint-seal strip 10 constructed in accordance with a preferred embodiment of the invention is disclosed for bridging a gap 12 as shown in FIGS. 2 and 3 between abutments 14 of a pair of structural slab members 16 as might be found in bridge, roadway and building construction.

The joint-seal strip 10 is of generally M-shaped cross section, and preferably formed of an extruding or molding process from any suitable resilient elastomeric or polymeric material 26 such as polyvinylchloride. The seal strip 10 includes a central web member 18 of substantially V-shaped cross-section spanning gap 12, and parallel, spaced flange portions 20, each integral with and extending along a longitudinal edge of web member 18.

Spring means such as a spring wire 22 is embedded within joint-seal strip 10 for exerting an outwardly directed force in the direction of the arrows in FIG. 2 for urging flange portions 20 into sealing engagement with the spaced surfaces 24 of abutments 14. The spring wire 22 is preferably arranged longitudinally in a serpentine or zig zag fashion with the adjacent loops of wire secured in place by longitudinally extending wire filaments in the manner disclosed in U.S. Pat. No. 3,928,898 to form an elongated spring wire web. The spring wire web is tensioned by bending it by any suitable means, not shown, into a web of substantially M-shaped cross section. Elastomeric material 26 is extruded or molded by any suitable equipment, not shown, onto the wire web to form an elastomeric spring expansion joint-seal strip 10 in which the spring wire 22 forces flange portion 20 outwardly.

The spring means can be formed in other suitable ways similar, for example, to the carrier shown in U.S. Pat. No. 3,928,898. In one form, the spring means may comprise a spring web having a solid elongated center portion provided with a plurality of spring fingers extending outwardly therefrom. In other possible forms, the spring means may comprise a solid or perforated spring web.

Gripping means such as one or more ribs 28 are provided on flange portions 20 for sealingly engaging surfaces 24 of abutments 14. The ribs 28 are integral with flange portions 20 and extend outwardly from the outer surfaces thereof in a direction away from the free ends 30 of the flange portions. When the joint-seal strip 10 is pressed into gap 12 between abutments 14, ribs 28 by virtue of their angular position easily compress and offer minimal resistance to installation of the seal. Strip 10 is pressed by any suitable device, not shown, that applies force vertically substantially at the center line of the seal. Once installed, as best illustrated in FIGS. 2 and 3, the ends 30 of the flange portions 20 engage shelves 32 on abutments 14, and ribs 28 sealingly engage abutment surfaces 24. The ribs 28 further, by virtue of their angular positions, offer high resistance to any effort made to remove the joint-seal strip 10 from its installed position.

With reference to FIG. 2, the joint-seal strip 10 is shown in its installed position bridging a wide gap 12 between a pair of slab members 16 which have contracted due to cold temperatures such as occur in winter. In FIG. 3, the joint-seal strip 10 is shown compressed by slab members 16 which have expanded to form a narrower gap, due to hot temperatures such as occur in summer. In either case, flange portions 20 and ribs 28 sealingly grip abutment surfaces 24 for securely holding the joint-seal strip 10 in its installed position, thereby preventing moisture, dirt or other foreign material from passing around the seal strip into the gap.

The abutments 14 in FIGS. 2 and 3 are preferably formed of metal and are secured by anchors 34 or the like to the ends of concrete slab members 16. Such abutments 14 can be eliminated, not shown, by molding slab members 16 to contain elongated shelves on the ends thereof for supporting ends 30 of flange portions 20 when joint-seal strip 10 is moved into its installed position.

The invention has been described in detail with particular reference to preferred embodiments, but it will be understood that variations and modifications can be effected within the spirit and scope of the invention.

I claim:

1. An expansion joint seal strip of a substantially M-shaped cross section for bridging a gap between spaced surfaces of a pair of structural slab members, said seal strip comprising:

an elongated central resilient web member of a substantially V-shaped cross section spanning the gap;

a longitudinally extending flange portion extending transversely to and along each longitudinal edge of said web member, and having one edge of each flange portion integral with an edge of said web member, and the opposite edge of each flange portion free, each flange portion having an outer side surface, and an inner side surface defining an acute angle with said web member; and spring means embedded within said web member for expanding said web member and urging said outer side surfaces of said flange portions into sealing engagement with the spaced surfaces on the slab members when said seal strip is compressed and inserted in the gap between the slab members.

2. The expansion joint seal strip according to claim 1 wherein said spring means comprises spring wire arranged longitudinally in a serpentine fashion.

3. The expansion joint seal strip according to claim 1 wherein said flange portions are substantially parallel, said seal strip further comprising gripping ribs on said outer side surface of each of said flange portions for sealingly gripping a corresponding surface on one of the slab members.

* * * * *